US005794721A

United States Patent [19]

Clonch et al.

[11] Patent Number: 5,794,721

[45] Date of Patent: Aug. 18, 1998

[54] DRILLING APPARATUS

[75] Inventors: David M. Clonch, Beckley, W. Va.; Jim Gibson, Bristol; Jeff Looney, Cedar Bluff, both of Va.

[73] Assignee: Long-Airdox Company, Blacksburg, Va.

[21] Appl. No.: 708,993

[22] Filed: Sep. 6, 1996

[51] Int. Cl.[6] ..... F21C 11/00

[52] U.S. Cl. ..... 175/45; 175/170

[58] Field of Search ..... 175/45, 170, 209, 175/219; 299/33; 405/303, 259.1

[56] References Cited

U.S. PATENT DOCUMENTS

| | | | |
|---|---|---|---|
| 2,854,217 | 9/1958 | Benjamin | 255/51 |
| 3,252,525 | 5/1966 | Pyles | 173/27 |
| 3,842,610 | 10/1974 | Willis et al. | 61/63 |
| 4,554,984 | 11/1985 | Hakes | 175/170 |
| 5,156,497 | 10/1992 | Gaskins | 405/291 |
| 5,312,206 | 5/1994 | Gaskins | 405/291 |
| 5,556,235 | 9/1996 | Morrison et al. | 405/303 |

*Primary Examiner*—William P. Neuder
*Attorney, Agent, or Firm*—Rudnick & Wolfe

[57] ABSTRACT

A system is provided for automatically maintaining the drill steel on its proper path during drilling. The drill is mounted at the end of an extendable boom, the extension of which can be controlled hydraulically. The orientation of the drill steel with respect to the boom is also controlled hydraulically. The boom can be elevated by a hydraulic system to drive the drill steel into the strata above. The position of the drill is calculated by a controller by means of several sensors. The controller then controls the extension of the boom and boom angle as well as the orientation of the drill with respect to the boom in order to maintain the drill steel in the proper position throughout the drilling process.

27 Claims, 8 Drawing Sheets

DRILLING APPARATUS

FIELD OF THE INVENTION

The present invention relates to mining bolter machines used in drilling holes and inserting bolts in mine roofs, and more particularly to a boom apparatus and control system for supporting a drilling box and for more accurately controlling the drill path.

BACKGROUND OF THE INVENTION

Mining bolter machines are used in the mining industry for drilling holes in the roofs of mines and inserting roof bolts therein at intervals to prevent collapse of the roof and reduce falling debris. The mining bolter machine moves within the mine and drills vertically into the strata above, moving the drill steel upwardly over a path of several feet. It is known to mount the drill on booms on the mining vehicle, which booms raise the drill steel to the ceiling. Because of the arcuate path described by the boom as it swings upward, various devices, such as linkages, have been developed to keep the drill steel on its true vertical path as it progresses into the strata. All of these various devices suffer from size, complexity, cost, or imprecision. If the path described by the drill steel is not precisely vertical, misalignments can occur which cause considerable stress that is a major cause of wear and damage to the drill steel and to the chuck that holds it.

After the hole has been drilled, a bolt must be inserted to a specified torque. Well-known methods are used to measure the torque of the bolts, but these usually involve a human operator. It is desired to be able to insert a bolt to the appropriate torque automatically.

SUMMARY OF THE INVENTION

It is an object of the present invention to automatically maintain a drill or drill steel "alignment" along a substantially single axis throughout a drilling operation by simple, compact, and reliable means.

Another object is for the rate of drilling to be controlled to the appropriate level despite variations in the characteristics of the strata.

Another object of the present invention is to collect time series data on the rotational speed and thrusting force of the drill steel in order to learn the characteristics of the strata.

Another object of the invention is to insert the bolts to the proper torque automatically.

Another object of the invention is to provide for a cover over the human operators of the machine to protect them against falling debris, which cover can be reliably used in a variety of orientations.

Another object of the invention is to provide a reliable and easy to use means for vacuuming the drilled-out strata as it is being drilled.

In accordance with the preceding objectives, the present invention relates to a system for automatically maintaining the drill steel on its proper path during drilling. The drill is mounted at the end of an extendable boom, the extension of which can be controlled hydraulically. The orientation of the drill with respect to the boom is also controlled hydraulically. The boom can be elevated by hydraulic means to drive the drill steel into the strata above. The position of the drill steel is calculated by a controller by means of several sensors. The controller then adjusts the boom extension and boom angle as well as the orientation of the drill with respect to the boom in order to maintain the drill steel in the proper position throughout the drilling process.

DETAILED DESCRIPTION OF THE PREFERRED EMBODIMENT

Figure 1:
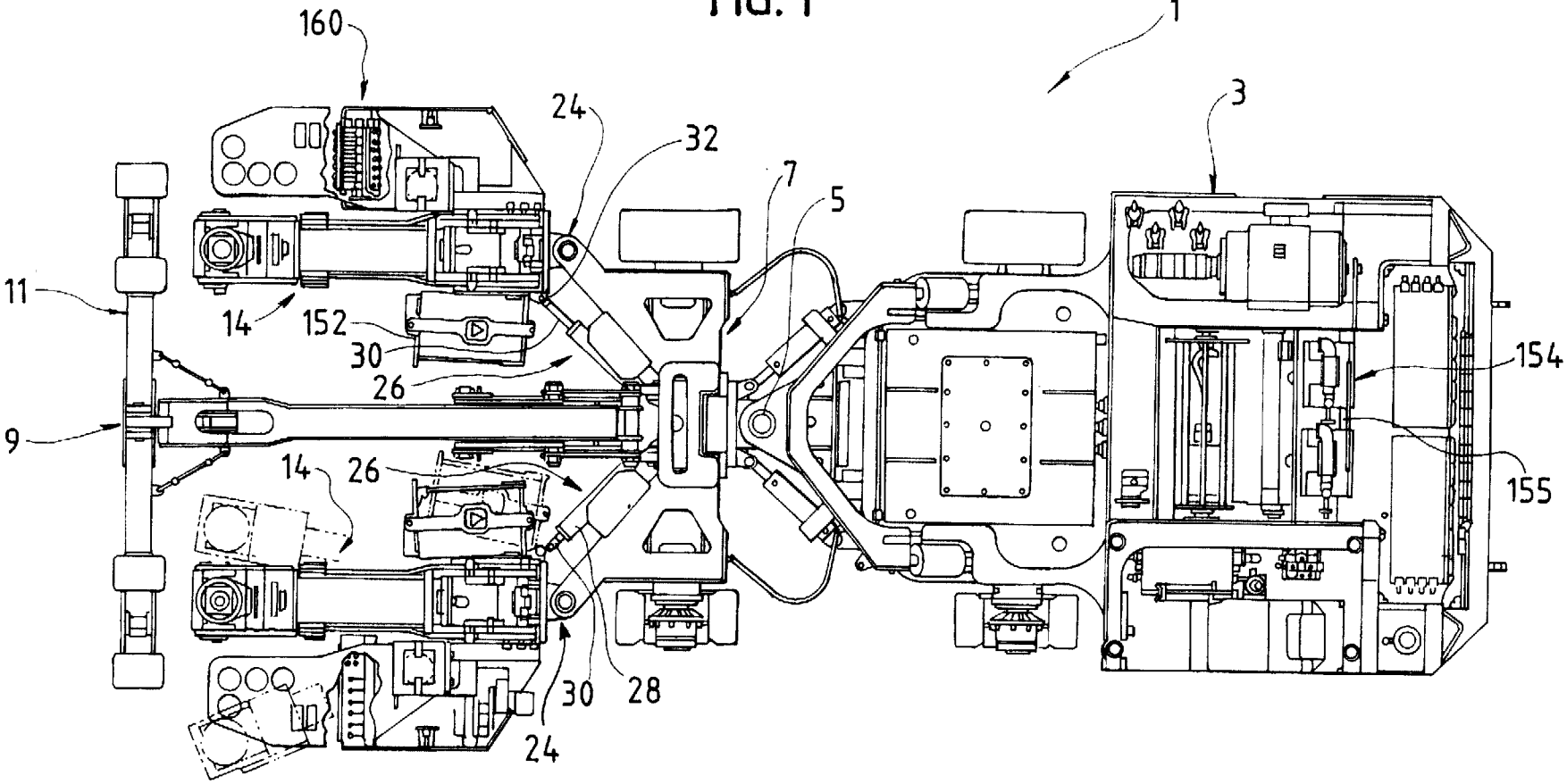
FIG. 1 is a top view of the mining vehicle with left and right drill boom assemblies.

Referring now to FIG. 1 there is shown a wheeled, mobile roof bolter 1 having a rear frame portion 3, a center frame portion 5 in front of rear frame portion 3, and a front frame portion 7 in front of the center frame portion 5, pivotably connected thereto. A longitudinal axis 9 extends along the length of the roof bolter 1, and frame portions 3, 5 and 7 are aligned on axis 9, as is conventional. Mounted on the roof bolter 1 are well known operational devices such as cable reel, electric motors, vacuum blowers, and control equipment (not shown). Such devices do not form part of this invention, and are thus not shown in detail. Positioned in front of front frame portion 7 and extending along axis 9 is an automated temporary roof support (ARTS) 11. The structure and operation of ARTS 11 is substantially as described in U.S. Pat. Nos. 5,156,497 and 5,312,206.

Figure 3:
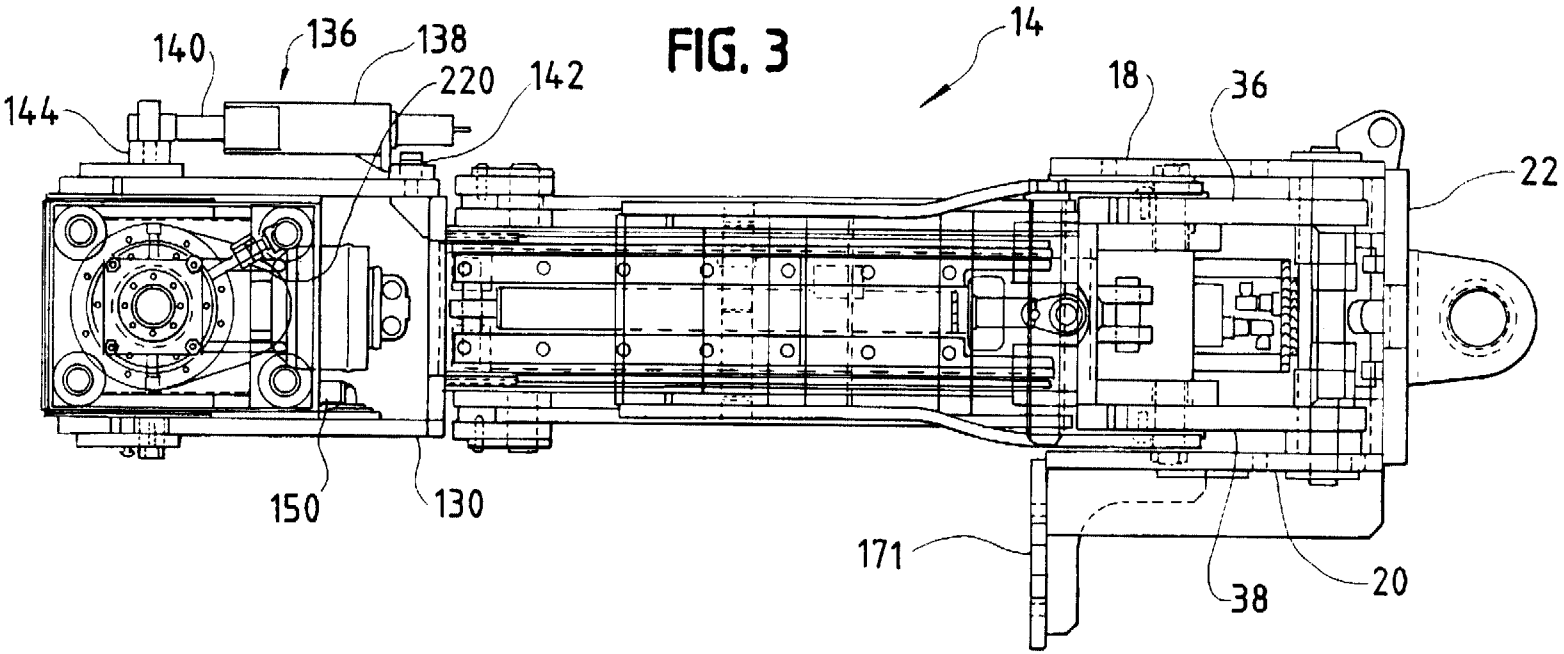
FIG. 3 is a top view of the left drill boom assembly of FIG. 1 with the drill canopy removed.
Figure 4:
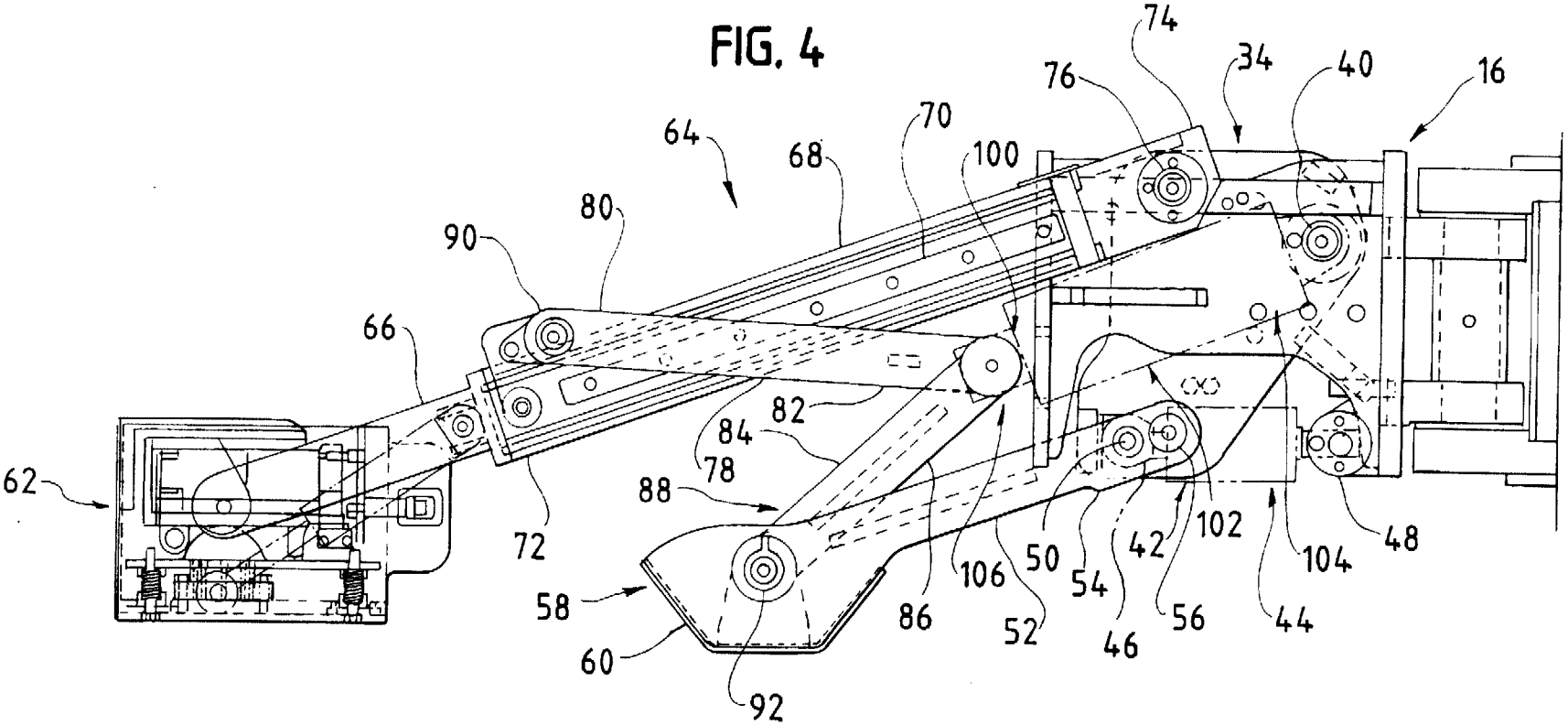
FIG. 4 is a side view of the left drill boom assembly of FIG. 3.
Figure 5:
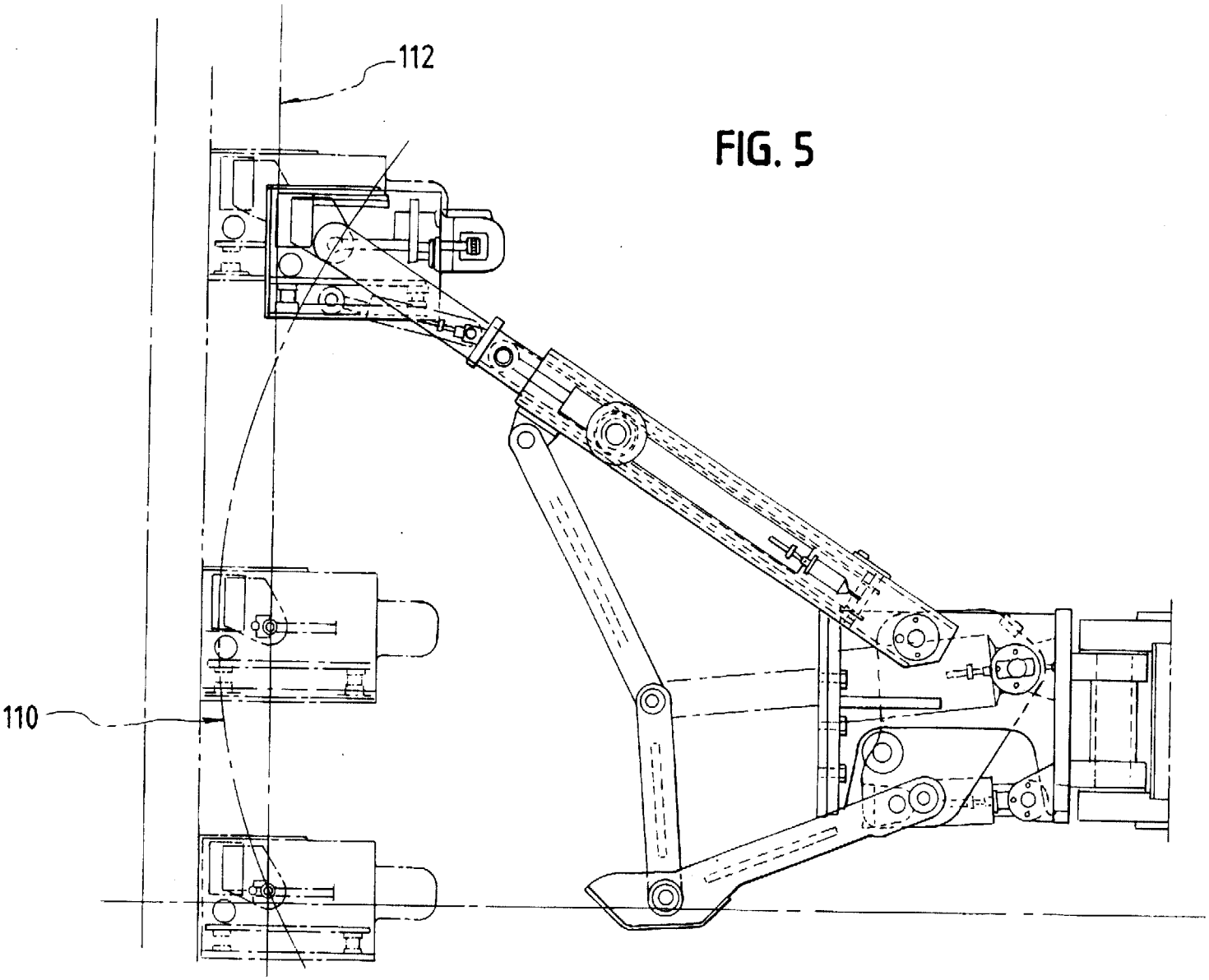
FIG. 5 is a side view of the left drill boom assembly of FIG. 3 with the drill boom raised and partially extended.

Pivotably connected to front frame portion 7, on both sides of the ARTS 11 and axis 9 are drill boom assemblies 14, which two drill boom assemblies 14 are mirror images of each other. FIGS. 3–5 depict a left boom assembly 14. For convenience and clarity, the specification is limited to describing in detail the left boom assembly 14.

The back portion of left drill boom assembly 14 includes a boom cradle assembly 16 comprising an inner plate 18, an outer plate 20, and back plate 22. Back plate 22 is pivotably connected to front frame 7 at swing joint 24. Mounted on frame 7 to the inside of each swing joint 24 is a swing drive, shown generally as 26, which includes a hydraulically operated cylinder 28 with an extendable shaft 30 therein, as is well known. Extendable shaft 30 is pivotably connected, at joint 32, to inner plate 18 of boom cradle assembly 16. By the movement of extendable shaft 30, swing drive 26 is able to rotate drill boom assembly 14 in a horizontal plane through a range of angles about swing joint 24.

Pivot cradle assembly 34 with an inside plate 36 parallel to an outside plate 38 is pivotably mounted between inner plate 18 and outer plate 20 of boom cradle assembly 16 at cradle joint 40. Cradle drive, shown generally as 42, which includes a hydraulically operated cylinder 44 with an extendable shaft 46 therein, is pivotably mounted on back plate 22 of boom cradle assembly 16 at joint 48, such that cradle drive 42 is between inside plate 36 and outside plate 38 and extends forward. Extendable shaft 46 is pivotably connected to pivot cradle assembly 34, at joint 50, such that as extendable shaft 46 moves forward and back, pivot cradle assembly 34 rotates in a vertical plane through a range of angles about cradle joint 40.

Stab shoe assembly 52 is a pair of spaced-apart sidewalls with a back end 54 pivotably connected to pivot cradle assembly 34 at joint 56, and a front end 58 with bottom plate, termed the "stab shoe" 60 adapted to rest on the mine shaft floor and support the weight of drill boom assembly 14.

Drill boom assembly 14 further comprises a drill box carrier assembly 62 mounted on boom assembly, shown generally as 64. Boom assembly 64 is comprised of an inner boom tube 66 which is capable of sliding in and out of outer boom tube 68. In the preferred embodiment, hydraulic sump cylinder 70 is located inside of outer boom tube 68 and also fits inside of inner boom tube 66. Sump cylinder 70 shaft extends forward, and extendable shaft is pivotably connected to inner boom 66. The rear of cylinder is connected to outer boom 68, and thereby the extension of inner boom tube 66 from outer boom tube 68. Outer boom tube 68 has a front end 72 and a back end 74. The back end 74 is pivotably mounted at joint 76 on pivot cradle assembly 34 between inside plate 36 and outside plate 38, such that boom assembly 64 can be rotated in a vertical plane through a range of angles about joint 76. Upper strut assembly 78 is a pair of spaced apart sidewalls with a upper end 80 and a lower end 82. Similarly, lower strut assembly 84 is a pair of spaced-apart sidewalls with an upper end 86 and a lower end 88. Upper end 80 of upper strut assembly 78 is pivotably connected at joint 90 to front end 72 of outer boom tube 68. Lower end 88 of lower strut assembly 84 is pivotably connected at joint 92 to stab shoe assembly 52, with the sidewalls of lower strut assembly 84 fitting between the sidewalls of stab shoe assembly 52. Lower strut assembly can rotate in a vertical plane through a range of angles about joint 92. Lower end 82 of upper strut assembly 78 is pivotably connected to upper end 86 of lower strut assembly 84 at scissor joint 100. Feed drive 102 includes a hydraulically operated cylinder 104 and an extendable shaft 106 therein, as is well known. Extendable shaft 106 is pivotably connected to scissor joint 100. The back end of hydraulically operated cylinder 104 is pivotably connected to boom cradle assembly 16 at cradle joint 40, fitting between inside plate 36 and outside plate 38.

Feed drive 102 serves to raise and lower the boom assembly 64 and the drill box carrier assembly 62 in a "scissoring" action that operates in the following manner. First, the stab shoe 60 is brought to securely rest on the floor of the mine shaft, in a manner to be hereinafter described. Then, the extendable shaft 106 is extended from hydraulically operated cylinder 104, pushing the scissor joint 100 forward. This causes lower strut assembly 84 to rotate counter-clockwise (as viewed in FIG. 4) about joint 92, and further causes upper strut assembly 78 to rotate in a clockwise direction about scissor joint 100. This rotation of upper strut assembly 78 pulls boom assembly 64 with it, causing boom assembly 64 to rotate in a clockwise direction about joint 76. As shaft 106 is extended, feed drive 102 is also rotated clockwise about cradle joint 40.

Figure 7:
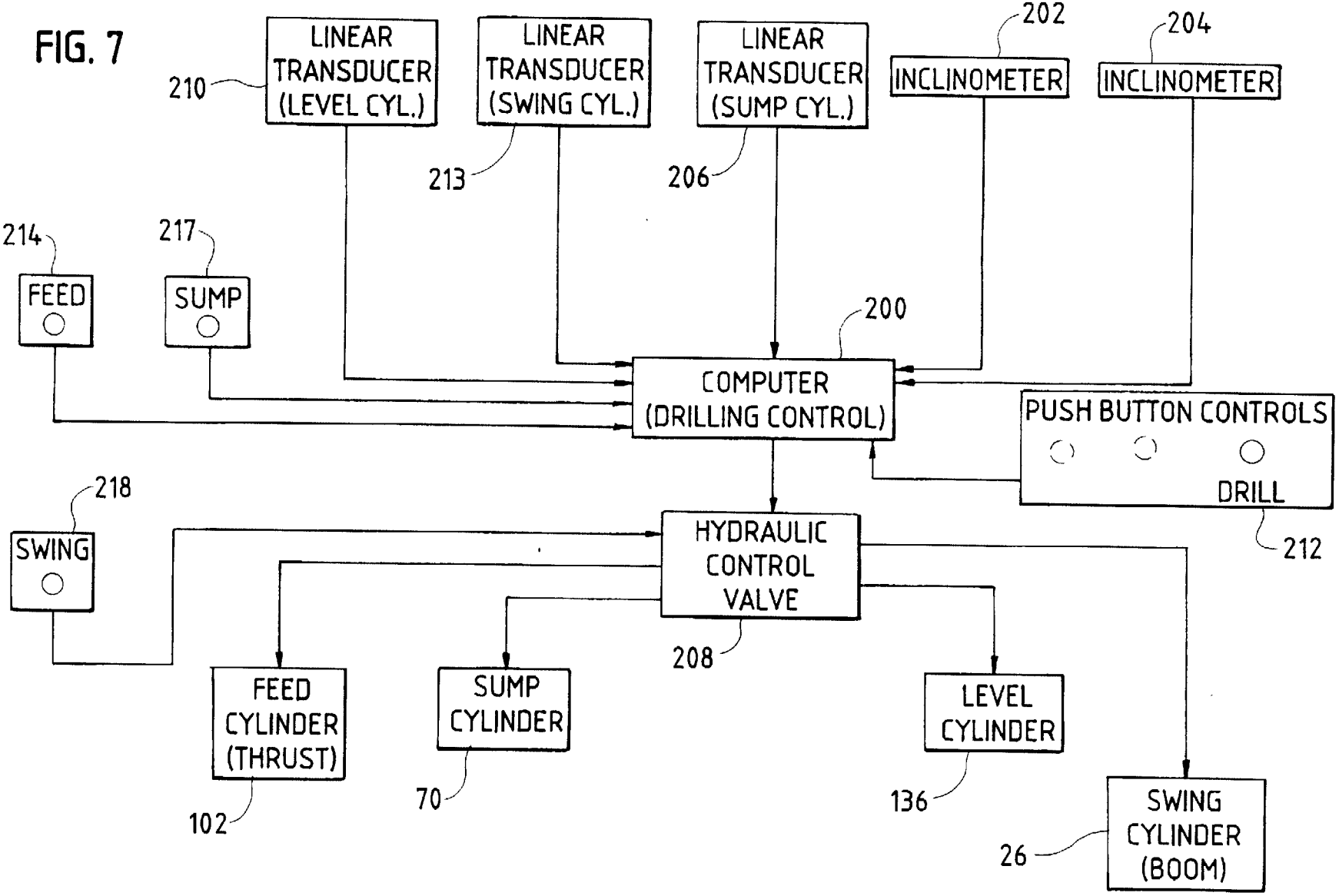
FIG. 7 is a schematic diagram of the drill steel positioning system.

FIG. 7 is a schematic diagram of the drill steel positioning system. In the present invention, this system is able to precisely control the position of the drill steel throughout the drilling process. In the preferred embodiment, the system is controlled by controller 200, appropriately programmed to perform the tasks hereinafter described. Included with the controller 200 are various analog-to-digital converters and digital-to-analog converters (not shown) appropriate for performing the tasks hereinafter described. Mounted on the outer boom tube 68 is boom inclinometer 202, which produces an electrical signal indicative of the angle of boom assembly 64 with respect to true vertical. Mounted on front frame 7 is vehicle inclinometer 204, which produces an electrical signal indicative of the angle of the front frame 7 with respect to true vertical. By comparing the signals from boom inclinometer 202 and vehicle inclinometer 204, the controller 200 is able to calculate the angle boom assembly 64 makes with that portion of the ceiling of the mine shaft where drilling is to take place, which portion would normally be parallel to front frame 7. Located on sump cylinder 70 is linear transducer 206 which produces an electrical signal indicative of the extension of inner boom tube 66 from outer boom tube 68. By processing the signals from linear transducer 206 and from the inclinometers 202 and 204, the controller 200 is able to calculate the position of the drill box carrier assembly 62 in a vertical plane which contains the axis of boom assembly 64. Moreover, controller 200 controls a hydraulic control valve 208, which in turn controls the sump cylinder 70 and the feed drive 102. By controlling the angle of boom assembly 64 by means of feed drive 102 and the extension of inner boom tube 64 by means of sump cylinder 70, the controller 200 is able to precisely position drill box carrier assembly 62 in the vertical plane containing the axis of boom assembly 64.

A linear transducer 210 is located in the tilt drive 136 which produces an electrical signal indicative of the extension of shaft 140 from cylinder 138. This extension is, in turn, indicative of the angle of the drill box carrier assembly 62 with respect to boom assembly 64, hereinafter the "tilt angle." The orientation of the drill box carrier assembly 62 is determined from the tilt angle with reference to the angle determined from the boom inclinometer 202. Referring to FIG. 7, the controller 200 is able to measure the tilt angle by means of linear transducer 210 and also to control the tilt angle by controlling the tilt drive 136 via hydraulic control valve 200.

As shown in FIG. 5, with inner boom tube 66 stationary with respect to outer boom 68, the rotation of the boom assembly 64 caused by operation of feed drive 102, moves drill box carrier assembly 62 to move in an arcuate path 110. However, the controller 200 of the present invention translates the inner boom tube 66 in or out from outer boom tube 68 the appropriate amount as boom assembly 64 is rotated, so that the drill box carrier assembly 62 moves vertically in a straight line path 112. In addition, throughout the drilling process, controller 200 adjusts tilt drive 136 in order to maintain the proper orientation of the drill steel with respect to boom assembly 64.

The stab shoe 60 is brought to rest securely on the floor of the mine shaft in the following way. With the feed drive 102 fully retracted, boom assembly 64 and stab shoe assembly 52 are roughly parallel so as to make a compact unit. The cradle drive 42 is able to pivot the pivot cradle assembly 34 about pivot joint 40, in the manner previously described, and this action also pivots boom assembly 64, feed drive 102, and stab shoe assembly attached thereto about joint 40. In this way, cradle drive 42 can adjust the angle of the boom assembly 64 and stab shoe assembly 52 so that they are roughly level with the vehicle 1. This low-profile configuration is the most convenient when the vehicle is moving through the mine shaft to find the desired location. Once a drilling location is found, the cradle drive 42 can be retracted until the stab shoe 60 securely contacts the floor.

Figure 6:
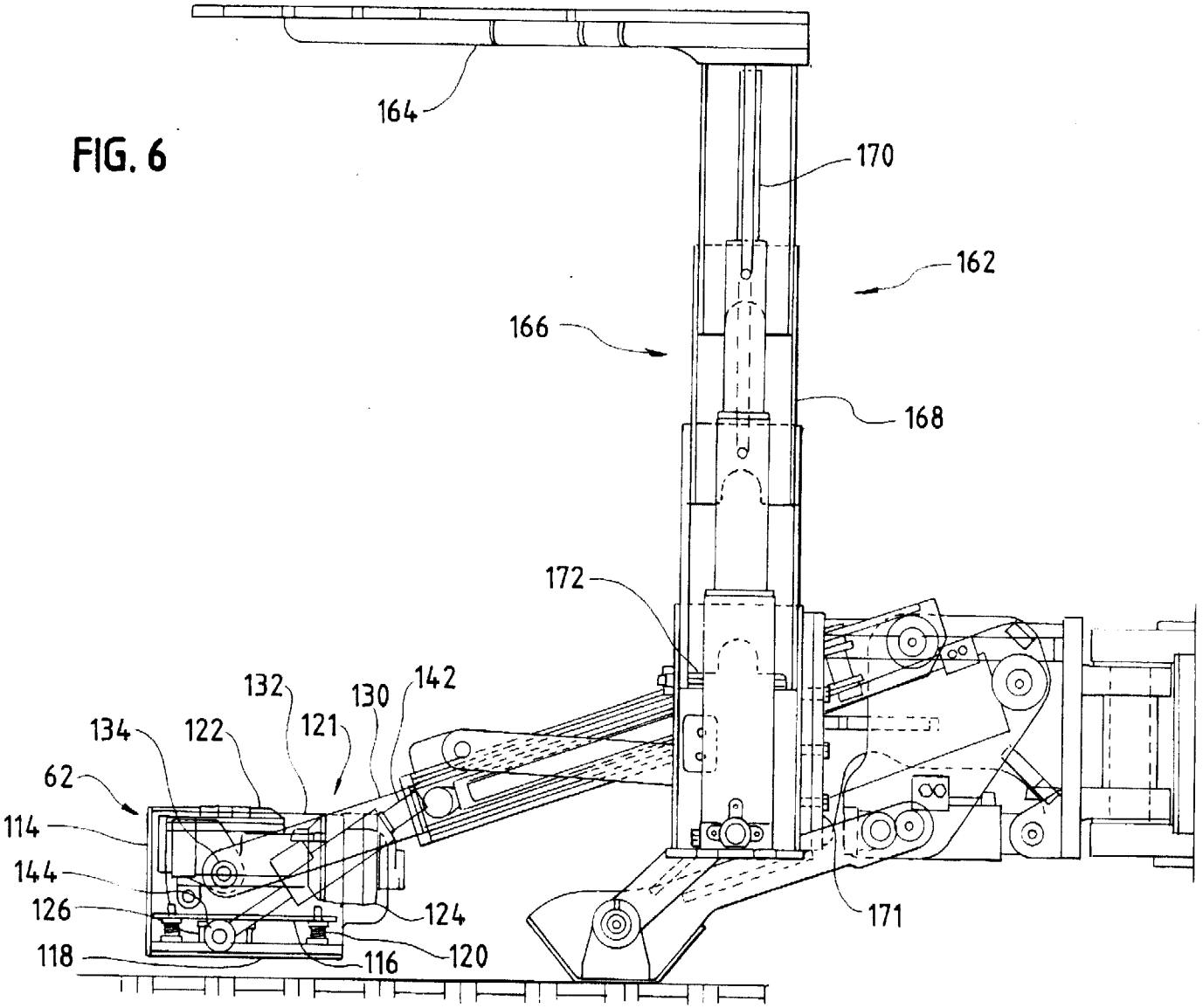
FIG. 6 is a side view of the left drill boom assembly of FIG. 1 with the drill canopy attached.

Referring to FIG. 6, drill box carrier assembly 62 includes a box housing 114, which is box-like in shape but open at the back and at the top. Baseplate 116 is mounted to the bottom portion 118 of box housing 114, via four springs 120. Mounted on the baseplate 116 is drill assembly 121 which includes a drill 122 and hydraulic motor 124 which drives it. Hydraulic motor is in turn driven by a hydraulic pump driven by an electric motor (not shown). The drill 122 is adapted for holding drill steels and bolts. Also located in drill assembly 121 is speed sensor 220 which produces an electrical signal indicative of the rate of rotation of the drill chuck. Mounted between baseplate 116 and bottom portion 118 is load cell 126, which measures the downward force exerted by baseplate 116. The load cell 126 is adapted for measuring the thrust of the drill as it drills into the strata, in a manner to be described hereafter. The four springs are adapted to support substantially all of the weight of the baseplate 116 and the items atop it when the device is not drilling, so that the load cell 126 reads essentially zero. When drilling takes place, the force of the drill steel as it is thrust into the strata compresses the four springs 120, and the load cell 126 then produces an electrical signal indicative of the drilling thrust.

Also mounted inside of box housing 114 is a torque cylinder 150 which is connected to the drill assembly 121 at one end and connected to one wall of box housing 114 at its other end. Located in torque cylinder 150 is pressure transducer 151 which produces an electrical signal indicative of the fluid pressure inside of the cylinder. When either drilling or bolting, the drill 122 will tend to twist with respect to the box housing 114 because of the torque it is exerting. This twisting will tend to compress the torque cylinder 150 and increase the fluid pressure therein. In this way, the electrical signal from pressure transducer 151 is indicative of the torque exerted by drill 122.

Also mounted in drill box carrier assembly 62 is a vacuum hose (not shown) which vacuums away dust and debris dislodged from the drilling process and deposits it in dust collection tank 152, mounted on drill boom assembly 14. Vacuum is developed by blowers 154, mounted on rear frame 3, which are connected to dust collection tank 154 by vacuum hoses (not shown). The vacuum system is provided with a vacuum sensor 155 that stops the feed when the vacuum in the lines decreases below a certain level. This vacuum sensing feature is to prevent drill box dust clogging.

The inner boom tube 66 has a front end prong portion 130 comprising two opposite sidewalls extending away from outer boom tube 68. The sides 132 of box housing 114 fit between the sidewalls of prong portion 130 and are pivotably connected thereto at tilt joints 134. Tilt drive 136 comprises a hydraulically operated cylinder 138 with an extendable shaft 140 therein. The back end of cylinder 138 is pivotably connected to prong portion 130 at joint 142, and the front end of extendable shaft 140 is pivotably connected to one sidewall of box housing 114 at joint 144. When the extendable shaft 140 is translated in and out of cylinder 138, drill box carrier assembly 62 is rotated with respect to boom assembly 64 in a vertical plane through a range of angles about tilt joint 134. In this way, tilt drive 136 is capable of tilting drill carrier box assembly 62 the appropriate amount to maintain a vertical orientation of the drill steel, throughout the full range of orientations of boom assembly 64.

Figure 2:
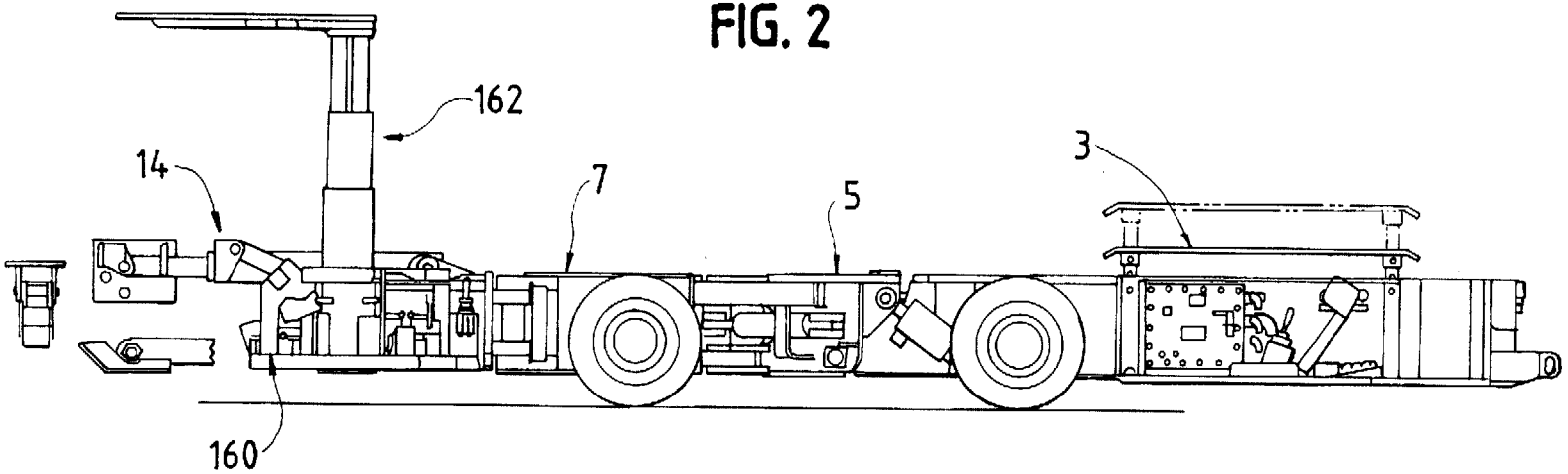
FIG. 2 is a side view of the mining vehicle of FIG. 1.

Referring to FIGS. 1 and 2, mounted on the outer side of each drill boom 14 are drill boom controls 160, which is where a human operator is stationed to control the drilling and bolting process. Mounted above the drill boom controls 160 is drill canopy 162, the purpose of which is to protect the human operator from any debris that might fall during the drilling process. Referring to FIG. 6, drill canopy 162 comprises a flat overhang 164 mounted on a vertical support 166. In the preferred embodiment, overhang 164 is T1 steel plate. Any other suitably rigid material would also suffice. The vertical support 166 comprises three outer sleeve sections 168 and four shaft sections 170 contained therein. Sleeve sections 168 are capable of translating inside of each other in telescopic fashion. Shaft sections 170 can also translate inside each other telescopically, and their extension is controlled hydraulically in the preferred embodiment. In this way, the height of vertical support 166 and hence the location of overhang 164 can be adjusted over an appropriate range. Vertical support is rigidly mounted to outer plate 20 of boom carrier assembly 16 via right-angle bracket 171. Located between sleeve sections 168 and shaft sections 170 are two spring spacers 172. The spring spacers 172 prevent the sleeve sections 168 from fully contacting each opposing sleeve section even when vertical support 162 is at an angle due to, for example, the vehicle 1 being located on inclined terrain.

In the preferred embodiment, the drill control 160 features a drill button, which when pressed, causes controller 200 to automatically control feed drive 102, sump cylinder 70, and tilt drive 136 for proper drilling. Drill control 160 also features a feed joystick 214, whereby a human operator can control the feed drive 102 for drilling, but controller 200 automatically controls sump cylinder 70 and tilt drive 136 for proper drilling. Drill control 160 also features a sump joystick 216, whereby a human operator can control the sump cylinder 70, but the controller 200 automatically controls tilt drive 136 for proper drilling.

Located in swing drive 26 is a linear transducer 213 which produces an electrical signal indicative of the extension of shaft 30 from cylinder 28, which signal is also indicative of the angle of drill boom assembly 14 in the horizontal plane, hereinafter the "swing angle." Controller 200 can process the signal from linear transducer 213 and control the swing angle by controlling the swing drive 26 via hydraulic control valve 208. Drill control 160 also features swing joystick whereby a human operator can control the swing angle.

Figure 8:
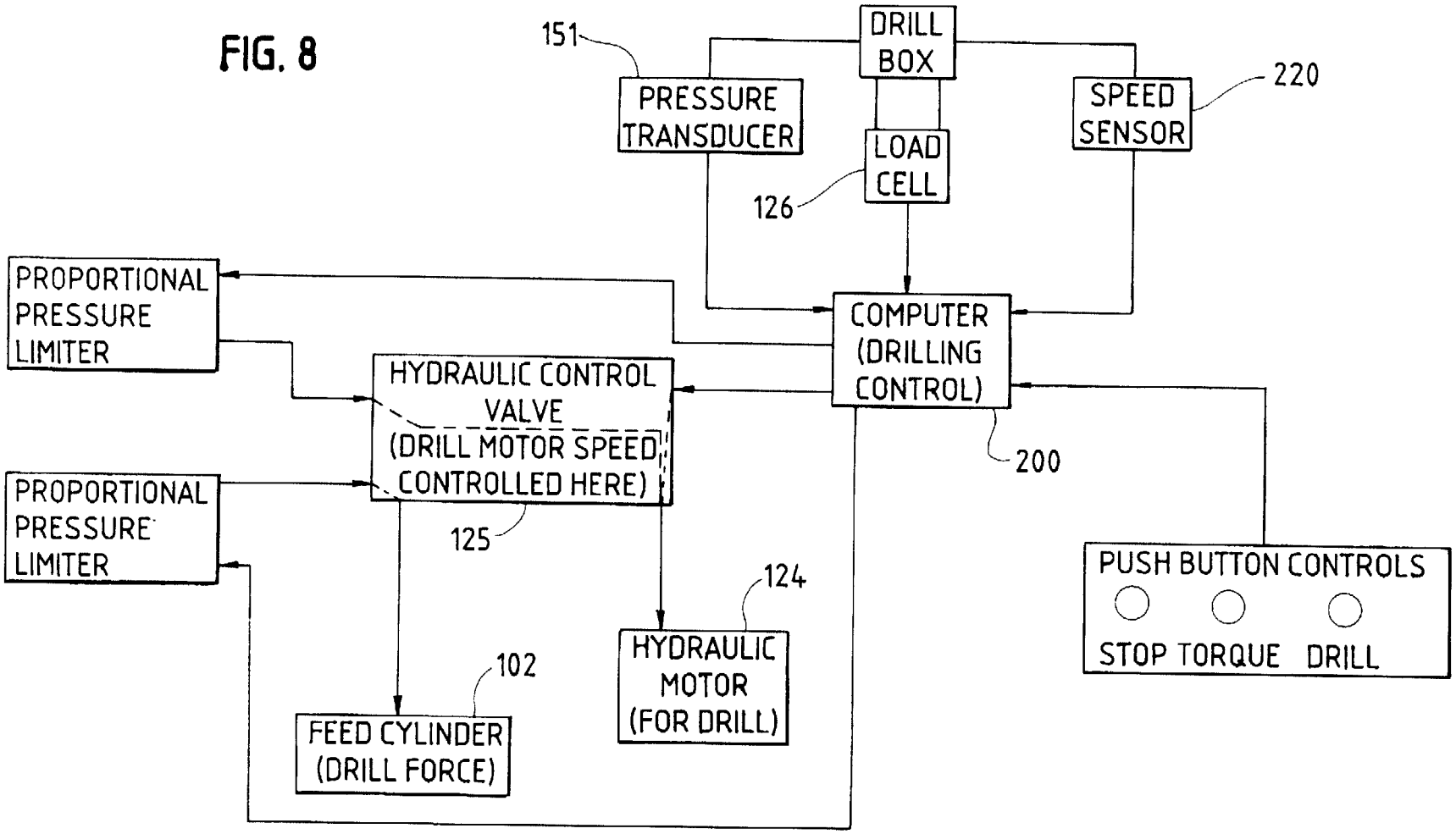
FIG. 8 is a schematic diagram of the drilling and bolting control system.

FIG. 8 is a schematic diagram of the drilling and bolting control system. Because of the possibilities of breakage and excessive wear of the drill steel, it is important to maintain the drilling rate at an appropriate level. When drilling, controller 200 measures the rotation speed of the drill 122 by means of speed sensor 220 and measures the force at which the drill steel is being inserted into the strata by means of load cell 126. Based on this data, controller 200 automatically controls the thrusting force of the drill steel by controlling feed cylinder 102 and automatically controls the rate of rotation of the drill steel by controlling the speed of hydraulic motor 124. When bolting, controller 200 automatically inserts the bolts by controlling the rotation of drill 122 via hydraulic motor 124 until the proper torque is reached as measured by pressure transducer 151.

The controller 200 is also adapted for storing the data received from the load cell 126 and speed sensor 220 over the course of a number of drillings. From this data, information can be ascertained about the strata the that was drilled into. The information about the strata can also be used to adjust the speed and thrust of the drill 122 during the drilling operation.

Figure 9:
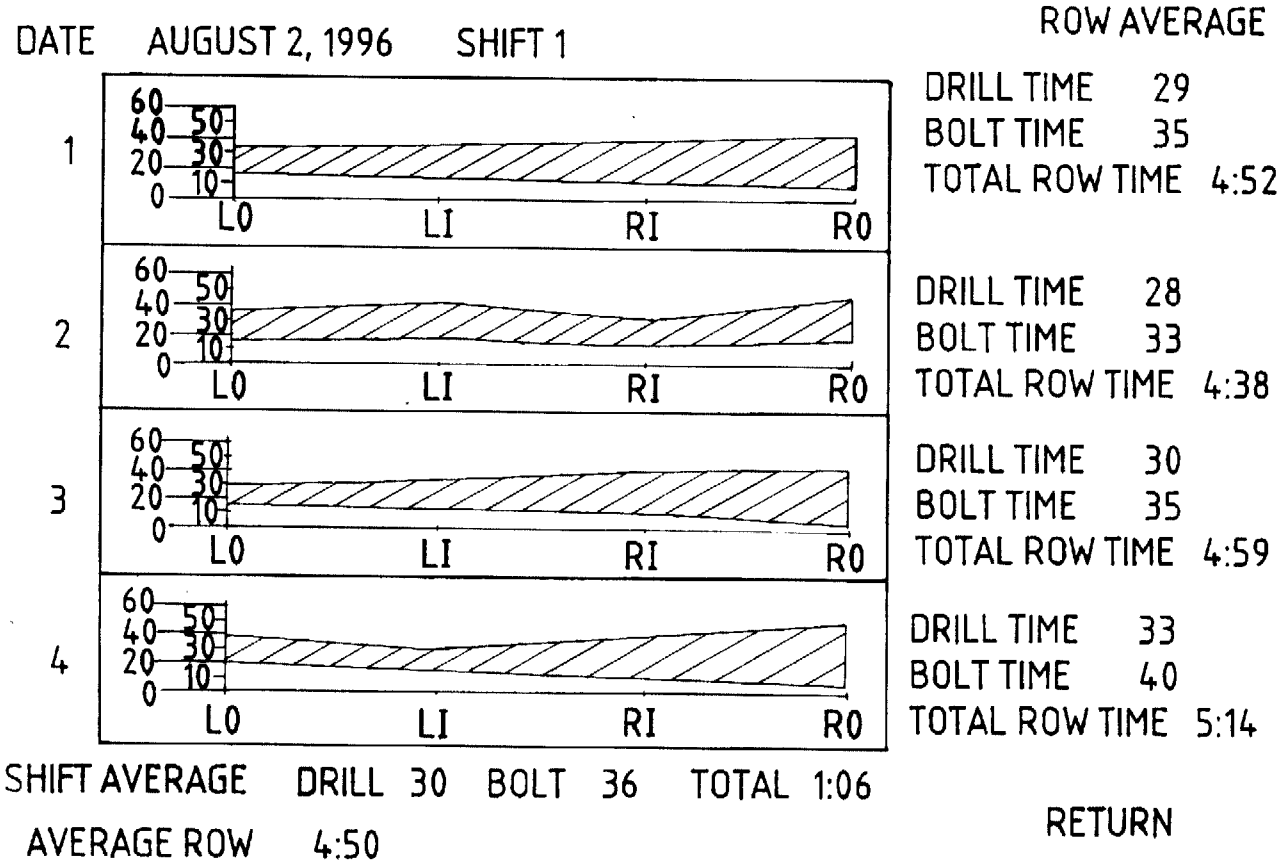
FIG. 9 is a graphical representation of the strata and drilling productivity.

FIG. 9 is a graph developed by the controller 200. The controller 200 develops information as to the density of the strata, such as whether the strata comprises soft, medium or hard density.

Row 1 of the graph provides information developed from one row of four hole/bolt combinations. Information developed from the left outside hole/bolt combination is plotted at the designation LO along the horizontal axis. The left inside hole/bolt combination is plotted at the designation LI, the right inside hole/bolt combination is plotted at the designation RI, and the right outside hole/bolt combination is plotted at the designation RO.

The vertical axis represents the depth of the hole in inches. For the example illustrated in FIG. 9, for the left outside hole/bolt combination in Row 1, it is shown that the strata is of hard density for approximately the first twenty inches, followed by approximately fifteen inches of soft density, and followed by approximately twenty-five inches of hard density. Similar information is obtained for the hole/bolt combination in LI, RI and RO. The density of the strata between the four hole/bolt combinations is extrapolated and plotted accordingly.

The drill productivity is also depicted to the right in FIG. 9. For Row 1, it is shown as an average drill time of twenty-nine seconds, and an average bolt time of thirty-five seconds and a total row time of four minutes and fifty-two seconds.

Similar information is shown for subsequent Rows 2, 3 and 4.

While the graph of FIG. 9 is limited to depicting the density of the strata as either soft or hard, other variations may also be plotted such as a medium density, for example.

We claim:

1. An apparatus for drilling, comprising:

means for drilling a hole;

means for supporting the drilling means;

boom means for connecting the drilling means to the supporting means for movement during a drilling operation; and means for controlling the boom means and the drilling means to move the drilling means along a substantially single axis throughout a drilling operation, the controlling means having a reference and means for detecting the position of the boom with respect to the reference.

2. The apparatus of claim 1, where the detecting means is an inclinometer mounted on the boom means.

3. The apparatus of claim 1, wherein the controlling means includes a tilt cylinder-having a first end coupled to the boom means and a second end coupled to the drilling means, means for controlling the length of the tilt cylinder, and means for detecting the length of the tilt cylinder.

4. The apparatus of claim 3, wherein the length detecting means is a linear transducer.

5. The apparatus of claim 3, wherein the controlling means includes a controller which is coupled to the means for detecting the angle of the boom means and to the means for detecting the length of the tilt cylinder.

6. The apparatus of claim 5, wherein the boom means includes a boom assembly having an outer boom tube and an inner boom tube.

7. The apparatus of claim 6, further comprising means for raising and lowering the boom assembly.

8. The apparatus of claim 7, wherein the raising and lowering means includes:

a strut shoe assembly having a rearward end pivotally coupled to the supporting means and a forward end having a bottom plate;

a lower strut assembly having a lower end pivotally coupled to the forward end of the strut shoe assembly, and an upper end;

an upper strut assembly having a lower end pivotally coupled to the upper end of the lower strut assembly, and an upper end pivotally coupled to the outer boom tube; and a feed cylinder having one end coupled to the supporting means and another end pivotally coupled to the upper end of the lower strut assembly and the lower end of the upper strut assembly, whereby the extension of the feed cylinder causes the boom assembly to raise.

9. The apparatus of claim 8, wherein the supporting means includes:

a boom cradle assembly having a left side, right side and rear side; and a pivot cradle assembly having a left side, a right side and a brace member, the pivot cradle assembly having a rear portion pivotally coupled to the boom cradle assembly between the left and right sides of the boom cradle assembly, the outer boom tube and the rearward end of the strut shoe assembly pivotally coupled to the pivot cradle assembly.

10. The apparatus of claim 9, further comprising a lift cylinder having a forward end pivotally coupled to a lower portion of the pivot cradle assembly and a rearward end pivotally coupled to the boom cradle assembly.

11. The apparatus of claim 8, wherein the drilling means includes:

a drill;

a motor for driving the drill;

an RPM sensor coupled to the drill;

a thrust sensor coupled to the drill;

the feed cylinder having means for detecting the length of the feed cylinder;

the controlling means coupled to the RPM sensor, thrust sensor and the feed cylinder detecting means; and the controlling means having means for detecting the RPM of the drill, the thrust of the drill, and the upward movement of the boom assembly, the controlling means having means for controlling the motor, whereby the speed and thrust of the drill are controlled during drilling operations.

12. The apparatus of claim 11, wherein the drilling means includes a drill box carrier, the drill box carrier having a drill box, the drill box having the drill chuck, the drill box carrier further includes the thrust sensor, the thrust sensor includes spring means, a load cell, and a plate resting on the spring means and the load cell, the drill box rests on the plate, whereby the load cell measures the thrust of the drill box.

13. The apparatus of claim 12, wherein the controlling means includes memory means for storing information from the RPM sensor, thrust sensor and the detecting means of the boom assembly, and further includes means for developing and providing roof strata depth and hardness information, and time studies.

14. The apparatus of claim 1, wherein the drilling means includes, a drill, a motor for driving the drill, and a means for measuring the torque of the drill, the measuring means coupled to thee controlling means, the controlling means having means for controlling the motor based on the torque of the drill, whereby the torque of the drill is measured.

15. The apparatus of claim 14, wherein the torque measuring means is a torque cylinder.

16. The apparatus of claim 14, wherein the torque measuring means is a pressure transducer.

17. The apparatus of claim 14, wherein the controlling means includes memory means for storing information from the torque measuring means, and means for providing bolt torque information.

18. The apparatus of claim 14, further including a dust collection tank, and means for detecting vacuum pressure, the controlling means including means for monitoring the pressure and means for regulating the pressure in response to the detected pressure.

19. A drill station canopy comprising:

a canopy cylinder;

an extendable sleeve, the canopy cylinder located within the extendable sleeve, the extendable sleeve including an outer canopy post and a first tube, the first stage tube slidably engaged partially with the outer canopy tube; and a canopy aligner, whereby the canopy is aligned so as to reduce misalignment of the first stage tube within the outer canopy post and reduce consequential wear.

20. The drill station canopy of claim 19, further comprising a second stage tube, the second stage tube slidably engaged partially with the first stage tube, whereby the canopy aligner reduces misalignment of the first and second stage tubes.

21. The drill station canopy of claim 20, further comprising a third stage tube, the third stage tube slidably engaged partially within the second stage tube, whereby the canopy aligner reduces the misalignment of the second and third stage tubes.

22. The drill station canopy of claim 21, wherein the canopy aligner includes at least one spring means having one end connected to the outer canopy post and the other end engaging the canopy cylinder, the spring means having means for adjusting the tension of the spring means exerted against the canopy cylinder.

23. An apparatus for drilling, comprising:

a mobile base;

a drill;

a boom coupled between the drill and the mobile base; and means for controlling the boom and the drill to move the drill along a substantial single axis throughout a drilling operation, the controlling means having a reference and means for detecting the position of the boom with respect to the reference.

24. The apparatus of claim 23, where the detecting means is an inclinometer mounted on the boom.

25. The apparatus of claim 23, wherein the controlling means includes a tilt cylinder having a first end coupled to the boom and a second end coupled to the drill, means for controlling the length of the tilt cylinder, and means for detecting the length of the tilt cylinder.

26. The apparatus of claim 25, wherein the length detecting means is a linear transducer.

27. The apparatus of claim 25, wherein the controlling means includes a controller which is coupled to the means for detecting the angle of the boom and to the means for detecting the length of the tilt cylinder.

* * * * *